United States Patent [19]

Adair

[11] Patent Number: 5,044,082

[45] Date of Patent: Sep. 3, 1991

[54] METHOD AND MEANS OF NOTCHING SHEETS

[75] Inventor: William A. Adair, Prospect Heights, Ill.

[73] Assignee: Teledyne Industries, Inc., Los Angeles, Calif.

[21] Appl. No.: 572,708

[22] Filed: Aug. 23, 1990

Related U.S. Application Data

[62] Division of Ser. No. 268,047, Nov. 7, 1988, Pat. No. 4,969,639.

[51] Int. Cl.[5] ..... B27G 17/02; B25F 3/00

[52] U.S. Cl. ..... 30/476; 30/133; 30/481

[58] Field of Search ..... 30/475, 476, 477, 481, 30/731, 480, 484, 133; 270/52.5

[56] References Cited

U.S. PATENT DOCUMENTS

| | | | |
|---|---|---|---|
| 2,597,158 | 5/1952 | Mastripolito | 30/481 |
| 2,699,805 | 1/1955 | Richter | 30/481 |
| 2,774,399 | 12/1956 | Emmons | 30/475 |
| 4,543,718 | 10/1985 | Duescher | 30/133 |
| 4,938,465 | 7/1990 | Marsiletti | 30/52.5 |
| 4,946,323 | 8/1990 | Kazama et al. | 30/477 |

*Primary Examiner*—Douglas D. Watts

*Assistant Examiner*—Paul M. Heyrana, Sr.

*Attorney, Agent, or Firm*—Lockwood, Alex, FitzGibbon & Cummings

[57] ABSTRACT

Rolls of paper are converted by unwinding, cutting and stacking into a relatively high stack of paper sheets of a predetermined uniform size. At least one of the vertical corners of the stack is removed by running an electrically driven manual planer down the corner so as to leave each sheet with one or more corners having a notch for use in orienting the sheet such as in feeding it into a copy machine. The planer is equipped with guide means so that the corner notches all have the same predetermined size and shape. The planer is preferably equipped with a vacuum hose which removes the debris as it is formed and conveys it to a vacuumized collection chamber. Preferably, the stacks of paper sheets are accumulated onto the deck of a pallet having on the underside a support integrally formed from a sheet of material so as to have parallel channel formations adjacent to and inset from opposite sides of the deck. It is also desired to provide a center-post or pedestal. One or more of the corners of the deck are preferably removed to accommodate the planer and to serve as a chip breaker for cleanly cutting the corner(s) from the bottom sheet(s) in the stack.

4 Claims, 2 Drawing Sheets

FIG. 1
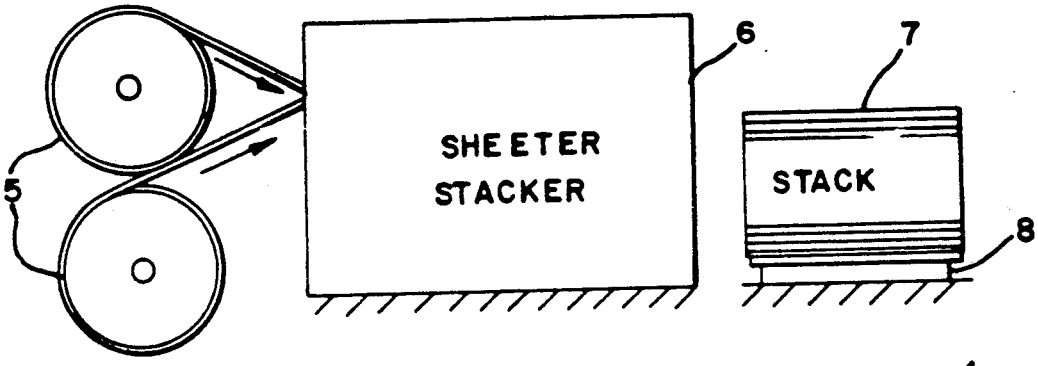
FIG. 3
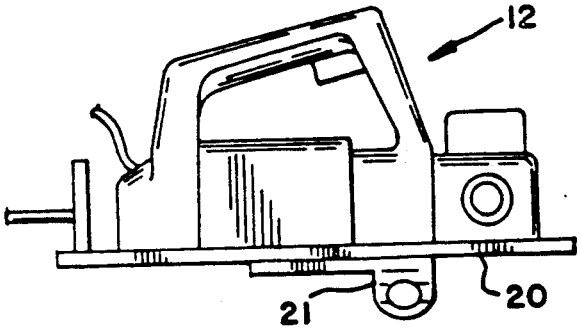
FIG. 4
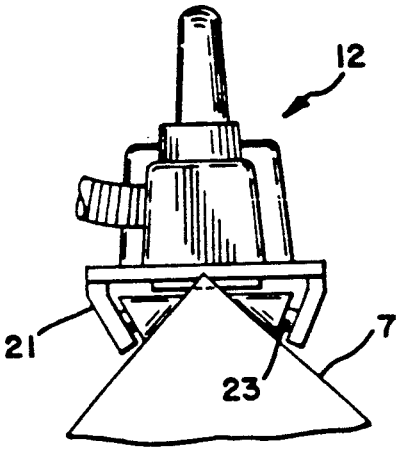
FIG. 5
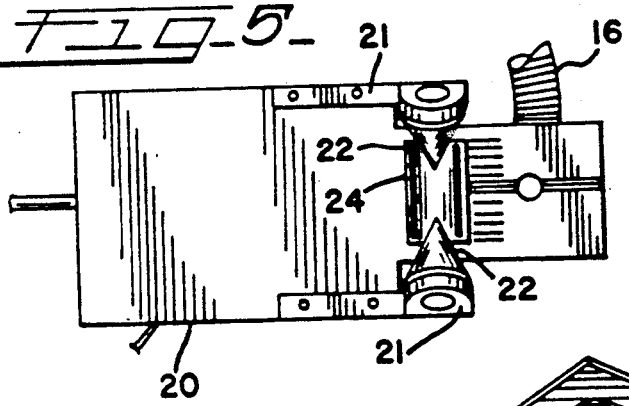
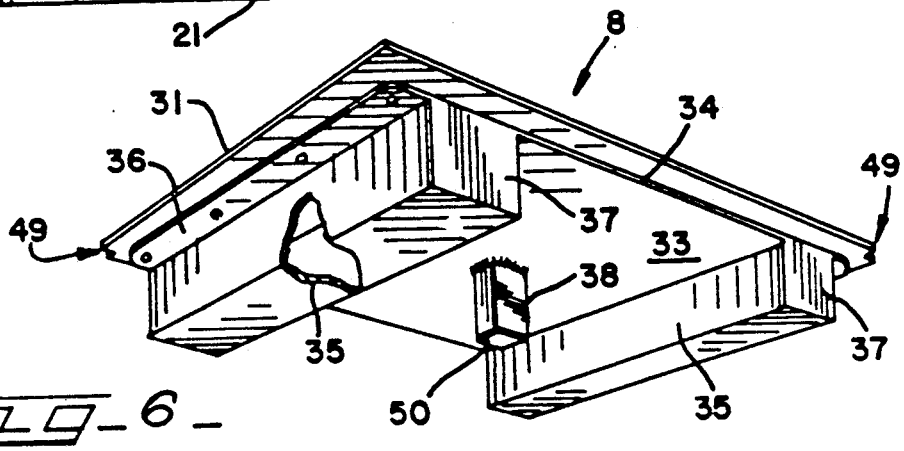
FIG. 6

METHOD AND MEANS OF NOTCHING SHEETS

This application is a divisional, of copending application(s) Ser. No. 07/268,047, filed 11/07/88 now U.S. Pat. No. 4,969,639 issued 11/13/90.

This invention relates generally to innovations and improvements in the method and apparatus for converting rolls of sheet metal such as paper into stacks of sheets with at least one corner of each sheet notched or removed so that the sheets may be oriented in use.

By way of example, in certain copying operations large sheets of copy paper are used which must be fed into a copier machine with one particular side of the copy paper up and the other side down. One way of providing a sheet with an indication as to how it should be oriented when fed into a copier is to notch or remove one of the four corners. The user then knows, for example, that if the sheet is fed into the machine with its notched corner in the left leading position the sheet will be properly oriented with respect to its top and bottom surfaces.

In production, paper for copy or other particular uses is manufactured as a continuous web and wound into large rolls. In practicing the present invention, these rolls are mounted in a machine in which the paper is continuously unwound and automatically cut into sheets of a desired length, with the individual sheets being allowed to accumulate vertically into stacks of desired heights. In the past it has been the practice to transfer such stacks which may be in the order of 50 inches high and contain as many as 7500 individual sheets to a notching operation. The notching operation heretofore used consists of removing a relatively small group of sheets (e.g. 25 to 250 sheets) from the large stack, adding a chipboard interleaf as a "lift" separator and stiffener for packages and placing the same in a mammal paper cutter accommodating a stack as high as 4 inches and equipped with guillotine type blade which cuts off or notches one of the corners of each small stack of sheets. It will be appreciated that this method and operation of notching is slow, inefficient and labor intensive since each small group or short stack of sheets must be first segregated and handled separately.

The present invention provides a method and apparatus whereby the notching or corner removing operation can be performed a great deal faster (i.e. several hundred times as fast) with a very small fraction of the labor previously required and with improved uniformity. Briefly, the method of the present invention comprises utilizing a manual electric planar equipped with guide means to remove one or more of the vertical corners of a large stack of sheets as produced in the sheeting and stacking equipment. Manual electric planers are available commercially and incorporate rotary cylinders equipped with cutter blades and can be modified and set so as to remove or plane away a desired thickness of material from the object being planed. The guide means allows unskilled personnel to accurately and uniformly notch the vertical corners of such large stacks of sheets. Preferably, vacuum means are provided for removing the debris as it is formed by the planer so as to be accumulated in a vacuumized receptacle for subsequent disposal. The notching operation is clean, fast and accurate and the equipment comprises readily available commercial components that can be readily modified assembled and installed.

The object of the invention, generally stated, is the provision of an improved method and means for performing the notching operation of the conversion of sheet material, e.g. paper, in the form of large rolls into stacked sheets having a particular corner of each sheet notched or removed for orientation purposes.

An important object of the invention is to perform the notching operation on sheets while they are still in large (i.e. high) stacks as accumulated in commercial equipment for converting rolls of sheet material into stacks of sheets.

Another important object of the invention is the provision of efficient high output equipment in the form of a manually operable commercial electric planar equipped with guide means which is capable of quickly planing off or notching the vertical corner of a large or high stack of sheets.

Another important object of the invention is the provision of a corner notching method and equipment whereby removal of more than the desired amounts of material at the corner is prohibited.

Another important object of the invention is the provision of pallets on which stacks of sheets produced in commercial converting equipment can be accumulated and which allow a vertical corner of a stack of sheets resting thereon to be notched or planed off and thereafter allow the notched stack to be moved to a packaging operation wherein individual groups of the notched sheets are removed and packaged in desired quantities.

Certain other objects of the invention will be apparent to those skilled in the art in view of the following detailed description of preferred embodiments of the invention taken in connection with the accompanying drawings, wherein:

FIG. 1 is a diagrammatic view of the overall sheet forming and sheet stacking equipment utilized in connection with the present invention;

FIG. 3 is a side elevation of a manual electrical planer that is used in practicing the invention;

FIG. 4 is a fragmentary bottom view taken on FIG. 2 showing un-notched bottom sheets and showing the relative position of the manually operable planer and the vertical corner of a stack of sheets as it is being planed off or removed in accordance with the present invention;

FIG. 5 is a bottom plane view of the planar shown in FIG. 3; and

FIG. 6 is a bottom perspective view of the pallet on which the stacks of sheets are supported as shown in FIG. 2.

Figure 2:
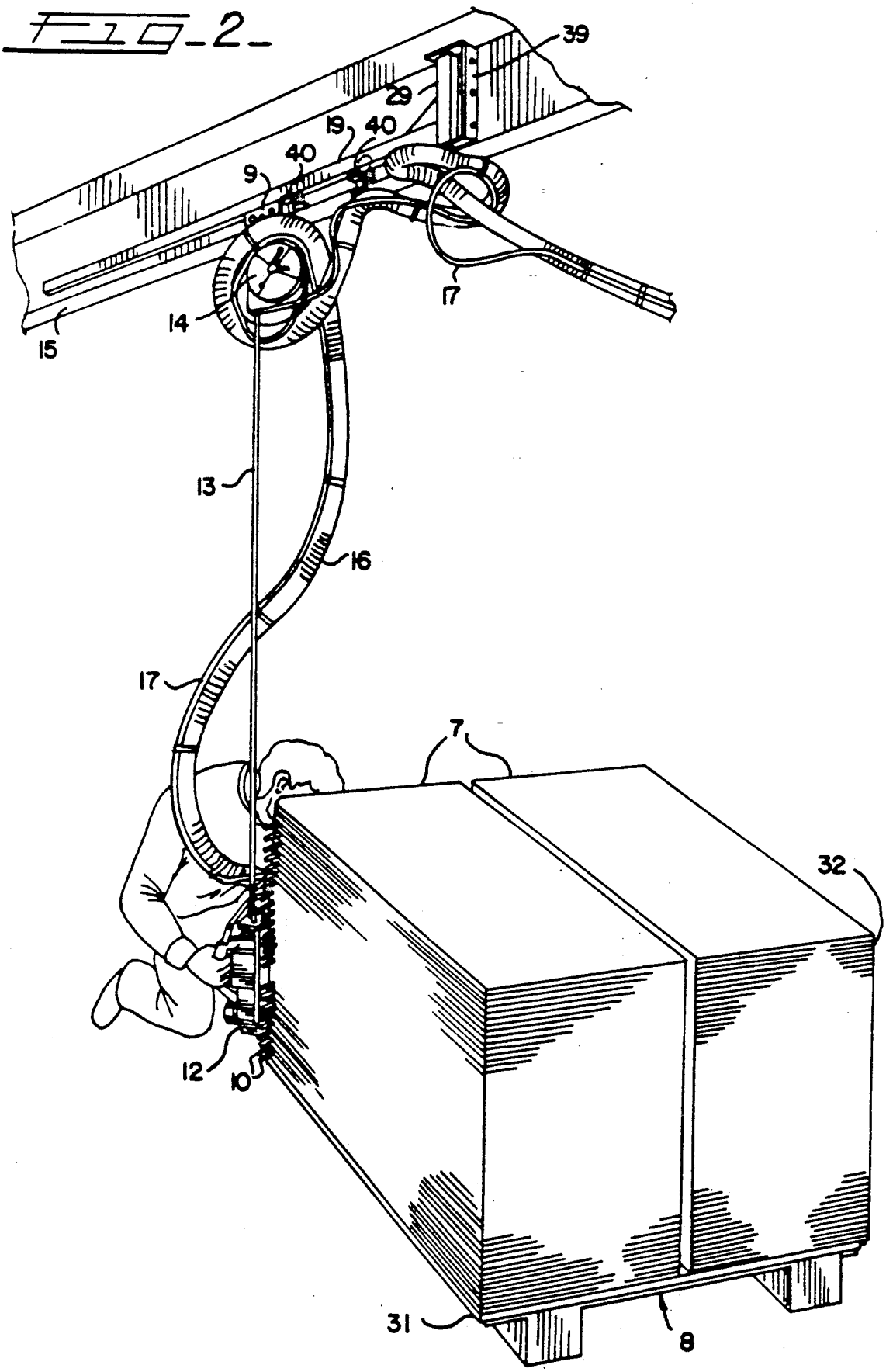
FIG. 2 is a fragmentary perspective view showing the equipment and illustrating the method for notching the vertical corner of a stack of sheets produced in the equipment shown in FIG. 1.

Referring to FIG. 1, two rolls of sheet material, e.g. copy paper 5—5, are shown being unwound and fed into a sheeter-stacker indicated generally at 6. This may be a known piece of commercially available equipment such as the sheeter-stackers of The Beck Company.

The web of paper in rolls 5 may typically have a width of 43 inches and the rolls may weigh approximately 1800 pounds each. The paper web may be unwound from the rolls 5 and fed into the sheeter-stacker 6 at a speed of approximately 600 feet per minute. In the sheeter-stacker 6 the webs are automatically severed transversely into predetermined lengths (e.g. 30 inches) and the resulting sheets are accumulated and stacked one upon the other. In this manner, stacks of sheets are created such as the stacks 7 which are deposited and supported on the pallet 8 in FIG. 1.

Preferably, the sheeter-stacker 6 includes a means for automatically inserting a marker strip 10 (FIG. 2) between sequential groups of sheets of a predetermined number, e.g. 100 sheets. Each such group of sheets is referred to as a "lift" and may be sheets of copy paper for use in a copy machine such as the Xerox #2510 Copier.

An operator will generally use a manual dolly to lift the pallet 8 with its two stacks 7 of sheets outwardly from the sheeter-stacker 6 to a position where the operator may manually remove or plane off one of the vertical corners of each stack 7 as illustrated in FIG. 2. In order to accomplish this notching or corner removing operation, the operator utilizes an electrically driven planer indicated generally at 12 attached to the end of a spring-loaded retractable support cable 13 housed in a reel 14 suspended by a hanger 9 mounted on an arm 19 attached at one end to the rotatable part 29 of a support fixture 39 mounted on a ceiling I-beam 15.

A length of flexible vacuum cleaner hose 16 is suspended by hangers 40—40 from the arm 19. The hangers 9 and 40 are equipped with rollers so that the reel 14 and hose 16 are movable on the arm 19 which can swing out from the I-beam 15. The hose 16 has one end attached to the planer 12 and the opposite end (not shown) attached to the suction inlet of a vacummized tank or receptacle (not shown). The flexible suction hose 16 has secured to it at intervals an electric conductor cord 17 for purposes of energizing the planer 12.

The planer 12 may be of known commercial type such as a Skil #98-Type 1 which has had guiding parts added. Suitable corner guide means are attached to the motor driven planer 12 as purchased. This guide means comprises a flat plate 20 which extends to the front of the tool 12 and carries two toed-in brackets 21 each of which in turn supports a conical roller 22—22 rotatably supported on a pin 23 projecting from the inside of each support 21. The cones 22 are 45° cones and they are so mounted that when they rollably or rotatably engage the vertical sides of a stack 7 adjacent one of its corners, the rotary cutter cylinder 24 of the planer 12 will remove or plane off a triangular strip including a 90° apex and two 45° angles between equal length sides of the base. The flat plate 20 in cooperation with the cones 22 prevents an operator from removing an excess of material during the notching operation thereby providing a fail-safe operation. If less than the correct amount of material is removed, the error can be readily corrected by repeating the notching step.

It will be understood that if desired the angle between the axes of rotation of the guide cones 22 could be such that the base angles could be different such as 30° and 60°. By utilizing unequal base angles totaling 90° the triangular notches that are removed can be used as a means of brand identification. It will be understood the base cut may be other than straight.

The operator in removing a vertical corner in one of the stacks 7 moves the planer 12 downwardly from the top of the corner to the bottom preferably in a smooth, continuous movement which the operator correlates with the capacity of the planer 12. Since the bottom of each stack is elevated above the floor level as it is supported on the pallet 8, the operator can completely remove the entire corner of a stack. Preferably, the appropriate corners 49 of the deck plate 30 of the pallet 8 are removed so as to allow the planer 12 to pass beyond the bottom sheet in each stack. The cut edge of a removed corner 49 of the deck plate 31 serves as a chip breaker in cutting of the lowermost sheets in a stack 7.

After the operator has removed the vertical corner from one of the stacks 7, he moves over and removes the corner of the other stack which is indicated at 32.

Referring particularly to FIG. 6, the pallet 8 comprises the deck plate 31 which may be advantageously formed of suitable strength plywood and a bottom support 33 formed from a sheet of material from suitable strength metal or plastic. The support 33 includes a flat or planar intermediate or central portion 34, two integrally formed channel formations 35–35 and two outwardly extending attachment flanges 36–36. The flanges 36 and the intermediate section 34 are coplanar and fit flatwise against the underside of the deck 31. Suitable fasteners are utilized to secure the support 33 to the underside of the deck 31. In order to provide additional strength, rigidity and safety, the opposite ends of the channels 35 may be closed by end plates 37—37 and a center pedestal or leg 38 may be attached. The distal end of the pedestal 38 is preferably closed by rigid material as indicated at 50 thereby strengthening the post and inhibiting damage to floor surfaces.

After the operator has notches the vertical corners of the two stacks 7, the stacks and pallet 8 may then be removed to the operator station of a dual packaging installation whereat one operator removes lifts from one of the stacks 7 and inserts them into envelopes or containers while the other operator removes lifts from the other stack and likewise inserts them in envelopes or other suitable containers.

It will be understood that while the invention has been described in particular relationship to the formation of suitably notched sheets of copy paper, it has application to other types of sheets including sheets formed of plastic or metal. Of course, the planer 12 has to be equipped with a cutter suitable for the particular type of material be it paper, plastic or metal.

What is claimed is:

1. Apparatus for planing off at a predetermined angle at least one vertical corner of a vertical stack of paper sheets so as to provide each sheet with at least one corner notched at a predetermined angle which comprises: a manual planer having guiding means for engaging each said vertical corner and cut off each said corner at a predetermined angle and having a debris discharge; debris removal collection means including a chamber and means for creating a vacuum within said chamber and a flexible conduit having one end communicating with the interior of said chamber and the other end communicating with said debris discharge; and a cable retractor supported above said vertical stack and including a retraction reel and a cable wound on said reel at one end and attached at its other end to said planer.

2. Apparatus for planing off at a predetermined angle a vertical corner of a vertical stack of paper sheets so as to provide each sheet with at least one corner notched at a predetermined angle which comprises, a planer having guiding means mounted thereon for engaging each said vertical corner and for cutting off each said corner at a predetermined angle, said guiding means comprising a pair of rollers engageable with the intersecting corner forming sides of said stack as said planer is guided down said stack corner and planes off said vertical corner.

3. Apparatus for planing off at a predetermined angle a vertical corner of a vertical stack of paper sheets so as to provide each stack with at least one corner notched at a predetermined angle which comprises, a planer having guiding means for engaging each said vertical corner and cut off each said corner at a predetermined angle, and wherein said guiding means comprises a pair of conical rollers mounted on the underside of said planer with the conical surfaces of said rollers engaging the intersecting vertical corner-forming sides of said stack as said planer is moved down said stack and planes off said vertical corner thereof.

4. Apparatus for planing off at a predetermined angle at least one vertical corner of a vertical stack of paper sheets so as to provide each sheet with at least one corner notched at a predetermined angle which comprises, a manual planer having guiding means for engaging each said vertical corner and cut off each said corner at a predetermined angle and having a debris discharge, and debris removal collection means including a chamber and means for creating a vacuum within said chamber and a flexible conduit having one end communicating with the interior of said chamber and the other end communicating with said debris discharge.

* * * * *